United States Patent [19]

Rymarchyk et al.

[11] 4,106,756

[45] Aug. 15, 1978

[54] OXYGEN LANCE AND SENSING ADAPTER ARRANGEMENT

[75] Inventors: Nicholas M. Rymarchyk, Pittsburgh; Leo L. Meinert, Baden, both of Pa.

[73] Assignee: Pullman Berry Company, Harmony, Pa.

[21] Appl. No.: 737,637

[22] Filed: Nov. 1, 1976

[51] Int. Cl.[2] ..... C21C 7/00; C21C 5/32

[52] U.S. Cl. ..... 266/99; 266/225

[58] Field of Search ..... 266/225, 226, 99

[56] References Cited

U.S. PATENT DOCUMENTS

| | | | |
|---|---|---|---|
| 3,161,499 | 12/1964 | Percy | 266/225 |
| 3,701,518 | 10/1972 | Herff | 266/226 |
| 3,827,632 | 8/1974 | Rymarchyk et al. | 266/225 |

*Primary Examiner*—Gerald A. Dost

*Attorney, Agent, or Firm*—Richard J. Myers; Thomas G. Anderson; John A. Doninger

[57] ABSTRACT

The invention is directed to a combination of a lance and nozzle assembly for supplying gas to a basic oxygen furnace. The lance and nozzle include an arrangement to accommodate a sensing device or unit which is adapted to transmit signals providing information in connection with the refractory or contents of the bath contained within the vessel. The arrangement is such that it accommodates the normal expansion and contraction of the lance resulting from the atmosphere within which the lance is utilized.

4 Claims, 9 Drawing Figures

50
46
48
47
45
41a
49
27
42
44
41
52
65
63
33
5
5
61
57'
60
60'
61
56
57
53
54
54
56
64
53
55
56
55
52
54
54
55
54
55
56
56
55
69
73
65
71
71

OXYGEN LANCE AND SENSING ADAPTER ARRANGEMENT

BACKGROUND OF THE INVENTION

1. Field of the Invention

This invention relates to the art of steel making equipment and more particularly to an improved gas lance which includes provisions and an arrangement adapted to support sensing devices for the purpose of securing various information relating to the condition of the refractory or bath in a basic oxygen furnace at any given time during the charge to tap stage of refinement or in the periods between these times.

2. Description of the Prior Art

The prior art relates to U.S. Pat. No. 3,620,455 patented Nov. 16, 1971; No. 3,827,632 patented Aug. 6, 1974. Patents particularly pertaining to sensor lances are 3,396,960, Aug. 13, 1968; 3,413,852, Dec. 3, 1968; and 3,727,897.

The present invention is an improvement in providing an arrangement particularly adapted to accommodate effectively different types of sensing or other devices which may be utilized in analysing the condition of the bath within the refractory in one or another stages of its refinement from charge to tap and in the periods between these times.

SUMMARY

An oxygen lance and nozzle includes a top adapter having a bushing sleeve connected thereto. The bushing sleeve is connected to a first pipe to which oxygen is supplied. A central second pipe is provided at its top with a piston sleeve slidably connected to said bushing sleeve. The lower end of the central pipe is attached at its lower end adjacent the outlet orifice of a nozzle. The central pipe encloses a conductor, either electrical, optical, or other, which includes an expansion loop or similar expansion means confined in the bushing sleeve. The lower end of the central pipe is provided with supporting structure for accommodating any sensing device which is arranged to transmit signals, or information it receives through the oxygen orifice concerning conditions relating to the contents within the refractory in one or another stages of its refinement from charge to tap and in the periods between these times. Such signals or information may be initiated through radar, optical, sonar or other electrical means and may relate to, but is not limited to pyrometric conditions, sound, heat, lights or metallurgical content.

DESCRIPTION OF THE PREFERRED EMBODIMENT

Figure 1:
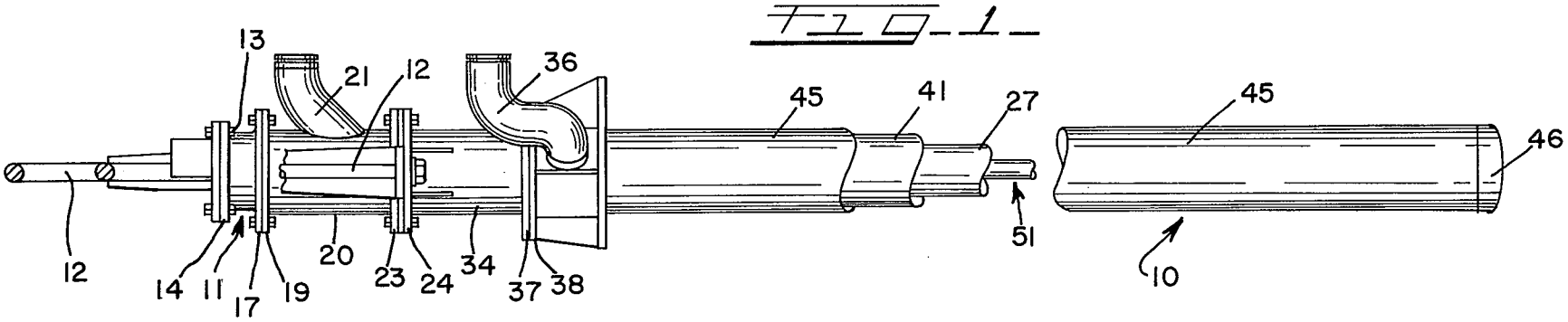
FIG. 1 is a side elevational view of a lance and nozzle combination.

FIG. 1 discloses a lance 10 having an adapter head 11, and a hanger 12 connected thereto. The head includes a bushing sleeve 13 provided with a flange 14 to which is connected a cover plate 15 by means of bolt and nut fasteners 16. The bushing sleeve 13 also includes a second flange 17 connected by means of bolt and nut fasteners 18 to a flange 19 attached to the upper end of a first pipe 20. The pipe 20 is provided with an oxygen inlet tube 21 communicating with an upper gas chamber 22. The first pipe 20 is provided with a quick disconnect coupling including a flange 23 connected to a flange 24 by means of bolt and nut fasteners 25. A second bushing sleeve 26 is connected to the flange 24.

A first tubular member 27 is provided with an upper piston sleeve 28 having O-ring seals 29 in sliding sealing relation with respect to the bushing sleeve. An inner sleeve 30 is connected to a ring 31 having O-ring seals 32 in engagement with the inner surface of the piston sleeve 28. The first tubular member forms an oxygen passage 33 in communication with the chamber 22.

A first pipe extension 34 is connected at its upper end to a flange 35 providing support for hanger members 12 from which the lance is hung when used in the vertical operating position. A water inlet connection 36 is connected to the pipe 34. The pipe 34 is connected to a flange 37 in turn connected to a flange 38 by fasteners 39. The flange 39 is connected to a ring 40 in turn connected to a second tubular member 41 providing a water inlet passage 42 communicating with the inlet connection 36. A water outlet connection 43 communicates with an outlet passage 44 provided by an outer third tubular member 45.

Figures 3, 4, 5:
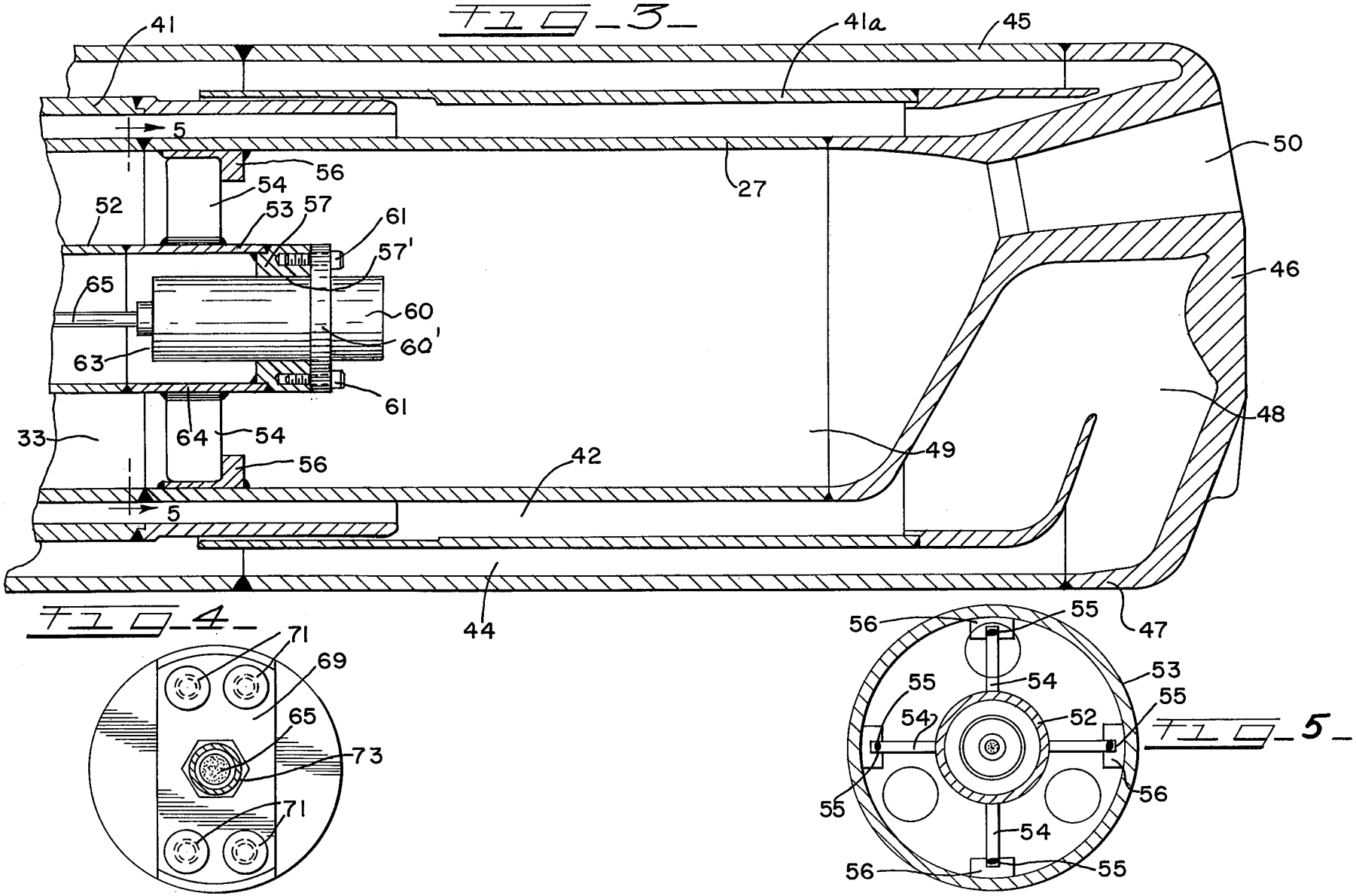
FIG. 3 is an enlarged cross-sectional view of a lower portion of the lance and nozzle disclosed in FIG. 1.
FIG. 4 is a cross-sectional view taken along the line 4—4 of FIG. 2.
FIG. 5 is a cross-sectional view taken along the line 5—5 of FIG. 3.

A nozzle head or lance tip is designated at 46 as best shown in FIGS. 1 and 3. As shown in FIG. 3 the nozzle 46 is provided with a cylindrical skirt 47 connected to the third or outer tubular member 45. The tubular members 27, 41 and 45 may comprise a plurality of individual sections as shown in FIG. 3 which are welded together for manufacturing reasons. The tubular member 41 includes a section **41*a* which is in overlapping relation with respect to the lower portion of the tubular member 41. The nozzle is provided at its lower end with a water chamber 48 which communicates with the inlet passage 42 and outlet passage 44. The oxygen passage communicates with an oxygen chamber 49 directing oxygen through one or more discharge orifices 50** to a suitable basic oxygen furnace vessel (not shown).

An arrangement and adaptation for supporting a sensing device is indicated generally at 51. This includes a central pipe 52 provided with centering spaces 52' to centrally space and support the central pipe relative to the tubular member 27.

The lower end of the sensor mounting is connected to a cylindrical sleeve 53 having a spider type arrangement including lugs 54 connected thereto. The lugs 54 are secured in slots 55 provided in brackets 56 to which they are secured by tack welding after alignment. The lower end of the sleeve 53 is sealingly secured to a cylindrical block 57 within a bore 57' within which a cylindrical housing 60 is supported. The housing 60 is supported by a circumferential flange 60' and cap screws 61 on block 57. A top plate 63 supports a conventional electrical outlet 64 which is connected to an electrical co-axial cable or conductor 65. The conductor cable may be straight or of serpentine configuration as disclosed.

Figure 2:
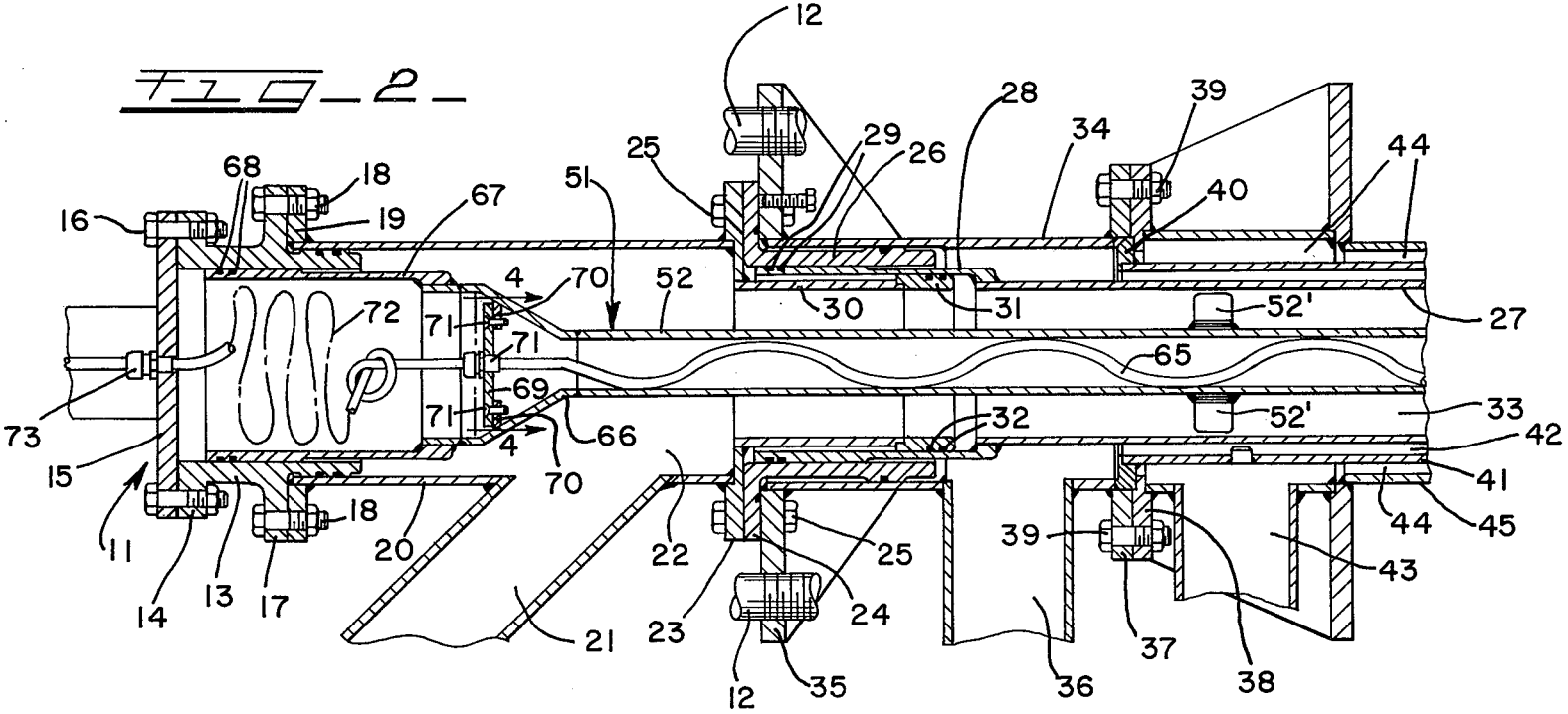
FIG. 2 is an enlarged cross-sectional view of the upper portion of the lance disclosed in FIG. 1.

As best shown in FIG. 2, the conductor cable 65 extends upwardly within the pipe 51 into a conical adapter 66, in turn connected to a third piston sleeve 67. The third piston sleeve 67 is in engagement with the inner surface of the bushing sleeve 13 and is sealed relative thereto by O-ring seals 68.

A bracket 69 is connected to lugs 70 carried by the adapter 66 by means of screws 71. A lock sleeve or screw type connector 71 supports the cable 65 on the bracket 69. The cable is formed with an expansion loop 72 disposed within the piston sleeve 67.

A lock sleeve 73 also secures the cable 65 to the plate 15. Lock sleeves 71 and 73 are of a conventional type for tightly securing the cable to the support 69 and plate 15. Thus the cable disposed below the support 69 is held within the pipe 52 in taut relation.

Figure 6:
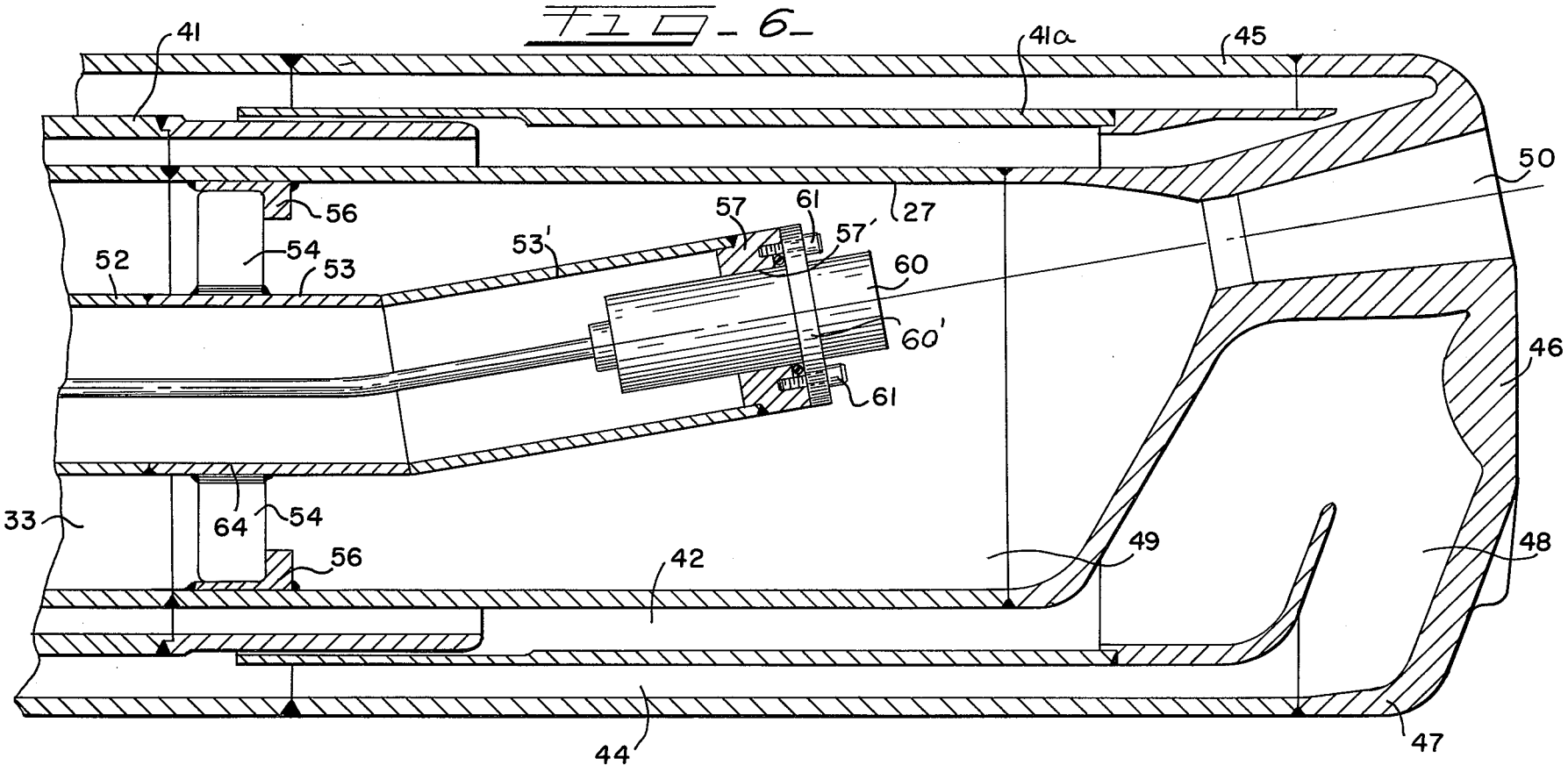
FIG. 6 is a view of a modified lower portion of the lance.

The modified constructions FIG. 6 discloses a lower portion of a modified lance. This lance is particularly adapted for a single orifice lance though it may be adapted to a multi-orifice lance where the signals are to be received through a single orifice.

In this modification a section of pipe 53' is connected to the lower end of the sleeve 53 and is disposed angularly to be in axial alignment with the discharge orifice 50. The other structure is similar and the same reference characters are applied.

Figures 7, 8:
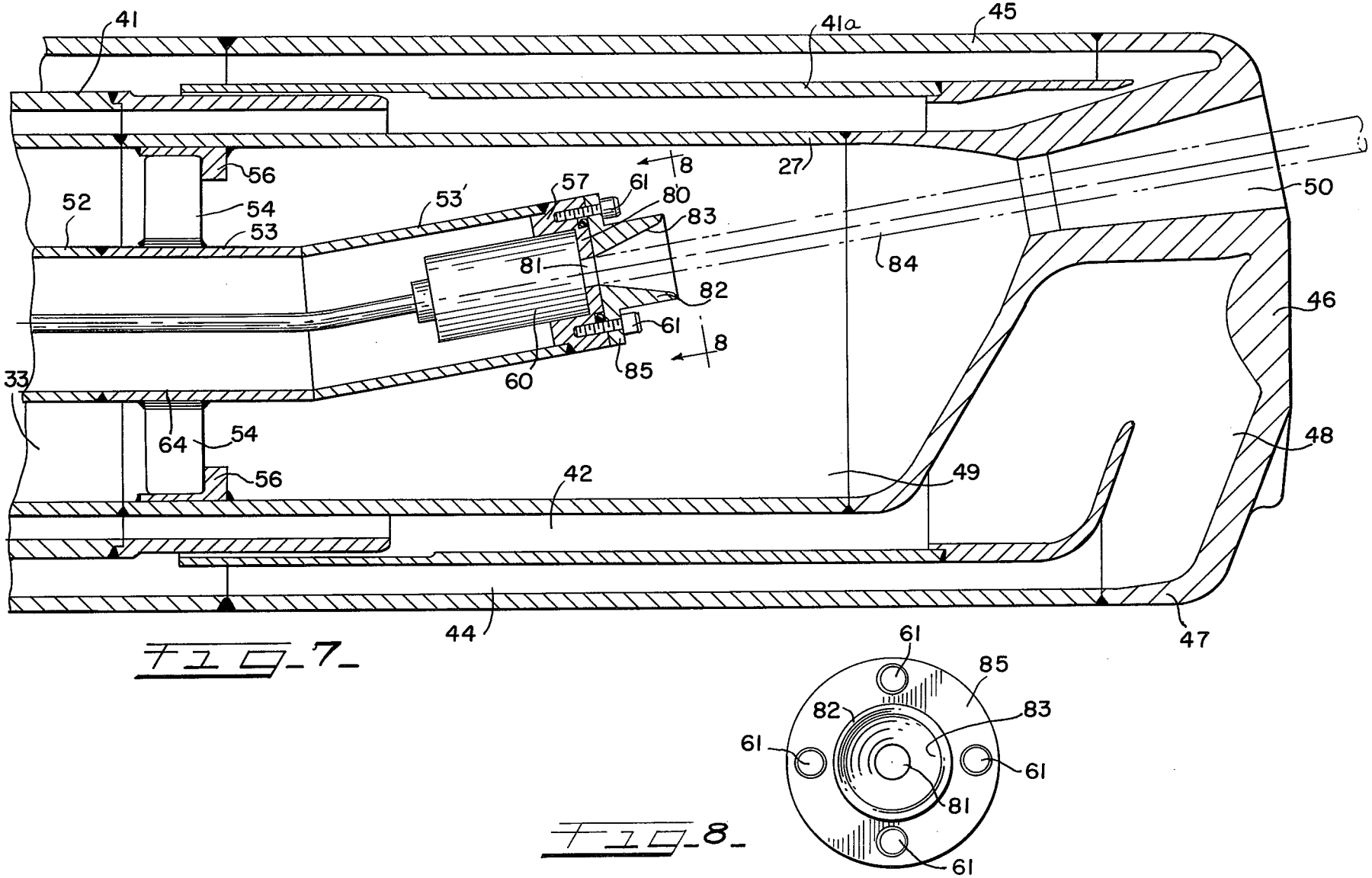
FIG. 7 is a view similar to FIG. 6 showing a modified instrumentation adapter.
FIG. 8 is a cross-sectional view taken along the line 8—8 of FIG. 7.

FIG. 7 discloses a lance similar to FIG. 6 with an adapter 82 connected to plate 80 on block 57 by means of cap screws 61 through a circumferential flange 85 provided on said adapter.

The adapter 82 includes a cave shaped opening 83 communicating with a holder opening or socket 81 within which may be secured a probe thermocouple or other instrument designated at 84.

Figure 9:
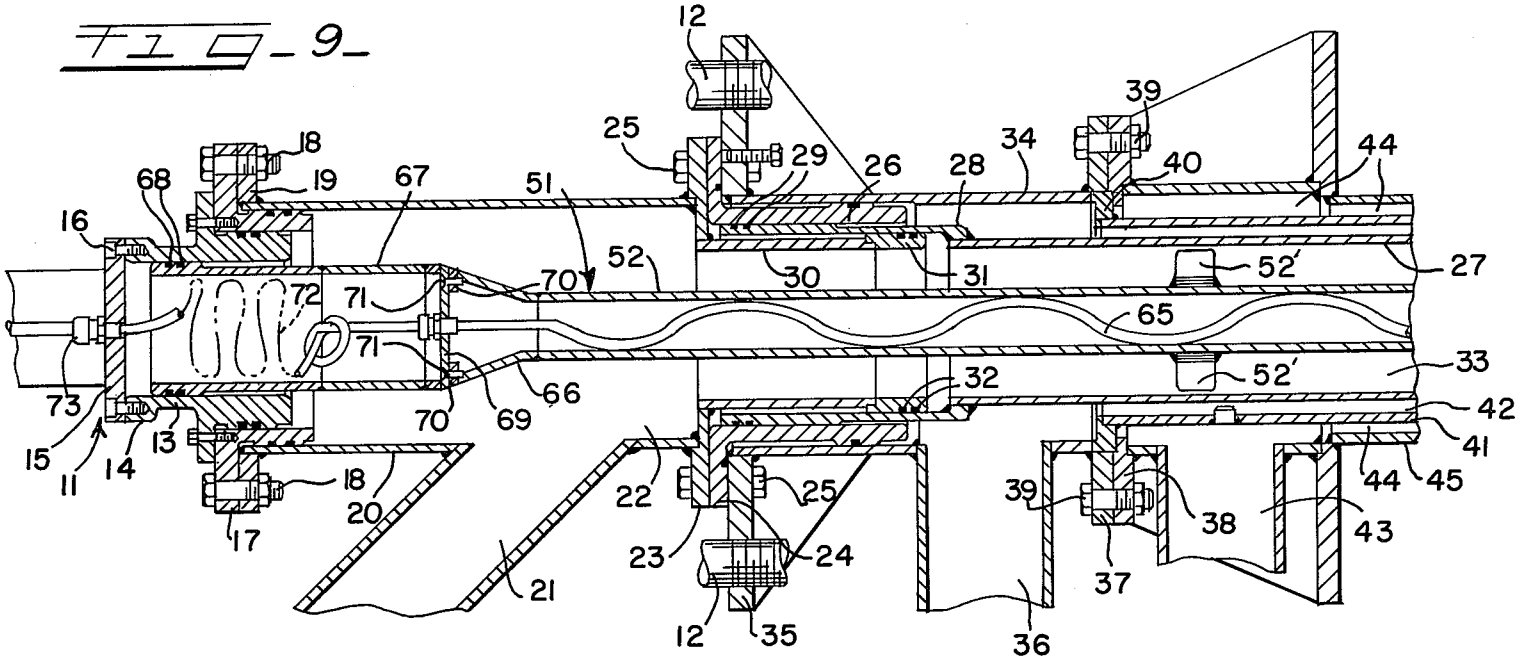
FIG. 9 is a cross-sectional view of a modified upper portion of a lance.

FIG. 9 discloses a modified top portion of the lance similar to FIG. 2 with the same reference characters applied. However in this case it will be noted that the third piston sleeve 67 has an outside diameter which is less than the diameter of the inner sleeve 30. This permits the sensing device arrangement 51 including centered pipe 52, third piston sleeve 67 and other associated structure to be drawn downwardly through the sleeve 30 for disassembly when required. Thus this modification permits withdrawl of the arrangement 51 through the top or through the bottom of the lance as desired.

THE OPERATION

In operation the lance 10 is hung vertically from the hanger 12 from suitable hoist structure and the nozzle is disposed within a B.O.F. vessel. Oxygen is directed through the inlet 21 through chamber 22, passage 33, chamber 49 and outwardly through the nozzles onto the surface of a molten bath. The lance is cooled by water entering into the water inlet connection 36 whereupon it circulates downwardly through passage 42, upwardly through water outlet connection 43. The O-rings seal the upper end of the pipe 52 against the entrance of oxygen and the lower sleeve structure 60 and block 57 prevent the entrance of any oxygen into the pipe 52. Further the interior of the pipe 52 may be vented, as disclosed in U.S. Pat. No. 3,827,632, to discharge any oxygen which may be inadvertently leaked into the pipe 52.

An electronic unit, or any other type of sensor may be placed within the housing 60 which provides a space which is isolated from the pipe 52. A sensor may be any signal conducting medium such as cable, wire, light transmitting medium or sonic transmitting medium. It may be a fiber optic conductor. The sensor which may be associated with the lance may be a probe or thermocouple as shown in FIG. 7, and is not limited to any type, it is intended that it may observe, see, read, receive, monitor and transmit conditions within the refractory. Such a sensor may be plugged into the electrical coaxial cable and will function to receive occurrences emanating from the refractory through the oxygen discharge orifice. Thus occurrences in the bath may be electronically communicated through the coaxial cable to suitable receiving means provided for this purpose. The sensor and receiving means will function to permit analysis of certain bath conditions which might be metallurgical, relate to sound and light or be pyrometric, etc., the primary purpose of the present invention being to provide an arrangement which can easily accommodate sensing devices in a lance that will function effectively and permit the safe, quick and reliable installation of such sensing devices.

The inner pipe will be protected against the inadvertent entrance and build up of oxygen in the pipe 52 by suitable vent means above referred to or by signalling means as deemed necessary for the beneficiation of the process involved.

Since the pipe 52 is provided with the piston sleeve 67 and first pipe 20, bushing sleeve 13, arrangement can contract and expand vertically as necessary to accommodate the extreme temperatures to which oxygen lances are subjected. Such expansion and contraction over the length of a lance assembly is considerable and the expansion loop 72 permits this to take place. The present arrangement can be utilized in various lances of different designs which have in common the contraction and expansion requirements described above.

The arrangement may be utilized with any gas lance or oxygen-oil or oxygen fuel burner lance where some form of sensor or information gathering means is to be incorporated. The central tube provides a safe and yet effective construction and shielding means for the cable conductor.

The arrangement shown may also be utilized with any signal or information transmittal method such as but not limited to light usuage or fiber optic transfer medium as well as the transmittal of an electrical signal by cable. It provides a safe and economic manner in which the desired result may be achieved.

What is claimed is:

1. A gas injection lance for insertion into a vessel for processing molten metal comprising:

a nozzle head at one end adapted to be positioned proximate to the molten metal, a plurality of concentric gas and coolant-carrying tubes at least the innermost gas-carrying tube of which is connected to the nozzle head in communication with said nozzle head for discharging gas therethrough, a sensor-mounting support positioned within said gas-carrying tube, a sensor mounted at one end of the sensor-mounting support proximate to and out of contact with said nozzle head and in axially spaced relation thereto and defining a gas-fillable thermal buffer zone chamber therewith, said nozzle head serving as a primary heat shield between the molten metal and said sensor, said buffer zone chamber, adapted for gasses therein being the sole body between the sensor and head and providing a supplemental dynamic heat shield between said nozzle head and said sensor, said nozzle providing a constricted unobstructed passage for draining a pressurized reservoir of gasses from said buffer zone chamber, and said chamber providing a gas-enveloping replenishable heat barrier about said sensor, and means removably mounting said sensor on the support including a sleeve portion and a mounting block fixed within the sleeve portion mounted on the end of said support, a housing having an annular flange seated against said block, and means securing said flange to said block.

2. A gas injection lance for insertion into a vessel for processing molten metal comprising:

a nozzle head at one end adapted to be positioned proximate to the molten metal, a plurality of concentric gas and coolant-carrying tubes at least the innermost gas-carrying tube of which is connected to the nozzle head in communication with said nozzle head for discharging gas therethrough.

a sensor-mounting support positioned within said gas-carrying tube, a sensor mounted at one end of the sensor-mounting support proximate to and out of contact with said nozzle head and in axially spaced relation thereto and defining a gas-fillable thermal buffer zone chamber therewith, said nozzle head serving as a primary heat shield between the molten metal and said sensor, said buffer zone chamber, adapted for gasses therein being the sold body between the sensor and head and providing a supplemental dynamic heat shield between said nozzle head and said sensor, said nozzle providing a constricted unobstructed passage for draining a pressurized reservoir of gasses from said buffer zone chamber, and said chamber providing a gas-enveloping replenishable heat barrier about said sensor, and said support having a sleeve portion and means mounting said sleeve portion from the innermost tube comprising bracket means extending from the innermost tube toward said support, and having slot means in the bracket means open axially toward one end of the lance, and lug means radially extending from said sleeve portion and extending into said slot means and means holding said lug means within said slot means.

3. A gas injection lance for insertion into a vessel for processing molten metal comprising:

a nozzle head at one end adapted to be positioned proximate to the molten metal, a plurality of concentric gas and coolant-carrying tubes at least the innermost gas-carrying tube of which is connected to the nozzle head in communication with said nozzle head for discharging gas therethrough, a sensor-mounting support positioned within said gas-carrying tube, a sensor mounted at one end of the sensor-mounted support proximate to and out of contact with said nozzle head and in axially spaced relation thereto, and means removably mounting said sensor on the support including a sleeve portion and a mounting block fixed within the sleeve portion mounted on the end of said support, a housing having an annular flange seated against said block, and means securing said flange to said block.

4. A gas injection lance for insertion into a vessel for processing molten metal comprising:

a nozzle head at one end adapted to be positioned proximate to the molten metal, a plurality of concentric gas and coolant-carrying tubes at least the innermost gas-carrying tube of which is connected to the nozzle head in communication with said nozzle head for discharging gas therethrough, a sensor-mounting support positioned within said gas-carrying tube, a sensor mounted at one end of the sensor-mounting support proximate to and out of contact with said nozzle head and in axially spaced relation thereto, and said support having a sleeve portion and means mounting said sleeve portion from the innermost tube comprising bracket means extending from the innermost tube toward said support, and having slot means in the bracket means open axially toward one end of the lance, and lug means radially extending from said sleeve portion and extending into said slot means and means holding said lug means within said slot means.

* * * * *